United States Patent [19]

Condo et al.

[11] 3,986,781

[45] Oct. 19, 1976

[54] STRUCTURE FOR PROTECTING AND INSULATING FROZEN SUBSTRATES AND METHOD FOR PRODUCING SUCH STRUCTURES

[75] Inventors: Albert C. Condo, Newtown Square, Pa.; George R. Knight, College, Alaska; Glenn R. Burt, Deer Park, Tex.; Alfred E. Borchert, Cherry Hill, N.J.

[73] Assignee: Atlantic Richfield Company, Los Angeles, Calif.

[22] Filed: July 25, 1975

[21] Appl. No.: 599,258

Related U.S. Application Data

[63] Continuation of Ser. No. 418,490, Nov. 13, 1973, abandoned, which is a continuation of Ser. No. 205,381, Dec. 6, 1971, abandoned.

[52] U.S. Cl. ..... 404/31; 61/36 A; 404/27; 404/82; 166/DIG. 1; 427/138

[51] Int. Cl.[2] ..... E02D 3/12; E01C 7/00

[58] Field of Search ..... 404/27, 31, 82; 61/36 A; 52/169, 408; 166/DIG. 1; 260/2.5 AZ; 427/138

[56] References Cited

UNITED STATES PATENTS

| | | | |
|---|---|---|---|
| 3,250,188 | 5/1966 | Leonards | 52/408 X |
| 3,279,334 | 10/1966 | Quartararo | 404/31 |
| 3,429,085 | 2/1969 | Stillman, Jr. | 52/169 |
| 3,473,951 | 10/1969 | De Rossi et al. | 428/320 X |
| 3,655,597 | 4/1972 | Strassel et al. | 260/2.5 AZ |
| 3,667,237 | 6/1972 | Dougan | 61/36 A |
| 3,839,518 | 10/1974 | Rubens et al. | 404/27 X |

FOREIGN PATENTS OR APPLICATIONS

| | | | |
|---|---|---|---|
| 1,903,914 | 9/1970 | Germany | 404/31 |
| 125,598 | 10/1972 | Norway | 404/31 |

*Primary Examiner*—Mervin Stein
*Attorney, Agent, or Firm*—Coleman R. Reap

[57] ABSTRACT

An insulating and protective structure for frozen substrates wherein a hydrophobic or water impermeable base layer is applied first to the substrate and successive layers of a polyurethane foam or similar synthetic plastic foam material are foamed in place on the base layer, each of said foam layers having a vapor penetration-resistant layer on its upper surface and below the next layer of foam. Finally, there is applied a hydrophobic or water impermeable layer to the upper surface of the uppermost vapor penetration-resistant layer.

This structure is designed particularly for application to substrates underlain with permafrost in the Arctic and sub-Arctic regions. It is designed to provide moisture penetration resistance, low thermal conductivity and to have both high compressive and flexure strength in order to impede heat transfer even with consequent freeze-thawing of the frozen substrate and likewise prevent physical damage to the surface of the substrate.

8 Claims, No Drawings

STRUCTURE FOR PROTECTING AND INSULATING FROZEN SUBSTRATES AND METHOD FOR PRODUCING SUCH STRUCTURES

This is a continuation of application Ser. No. 418,490 filed Nov. 13, 1973, and now abandoned, which in turn is a continuation of Ser. No. 205,381 filed Dec. 6, 1971, and now abandoned.

BACKGROUND OF THE INVENTION

1. Field of the Invention

This invention relates to a structure for protecting and insulating frozen substrates such as the permafrost in the Artic and sub-Arctic regions which comprises a base layer having hydrophobic or water impermeable properties applied to the frozen substrate with successive layers of a synthetic plastic foam such as polyurethane foam foamed in place on the base layer, each of such layers being separated from the next succeeding layer by a vapor penetration resistant layer and a hydrophobic or water impermeable layer applied to the uppermost vapor penetrationresistant layer.

2. Prior Art

The regions of the Arctic and sub-Arctic zones wherein perpetually frozen ground starts a few feet below the surface and extends downwardly to great depths are generally referred to as the permafrost regions. This permafrost is permanently frozen ground and consists of mixtures of varying content of water, salt, sand and gravel. In many cases the ice content of the upper portions may exceed 90 per cent of the total volume. This obviously is susceptible, therefore, to thawing whenever ambient temperatures exceed the freezing point of water.

At the surface of the ground there is an active growth layer called the tundra which covers the permafrost. In the winter months the ground is frozen solidly to the very surface of the tundra, but in the spring and summer thawing occurs to varying depths ranging from a few inches to several feet in an area between the tundra mat and permafrost zone which is called the "active layer". If left undisturbed the spring and summer thaw converts the tundra and active layer into a soggy marsh and thus the solid frozen ground which during the winter months can support excessively heavy loads, in the summer months is virtually incapable of being traversed by wheeled vehicles. Moreover, if during the winter months vehicles traverse an area of the tundra to such an extent that its surface is rutted even to a relatively small degree these ruts in the summer may subside or erode and can become gullies which release torrential and damaging run-offs, thus potentially permanently damaging the underlain permafrost and additional tundra structure.

The most common method of constructing roads, airfields and similar structures proposed for the permafrost region comprises depositing gravel on top of the tundra to a depth such that the gravel provides an insulating layer below which the active layer region remains frozen even during the summer thaws thereby protecting the underlain permafrost and thus provides a solid base for the roadway or other similar structure. Ideally, this gravel layer is sufficiently thick such that the frozen condition will actually form or penetrate up into the lower portion of the roadway gravel itself. In order to provide this insulating and protective structure the gravel thickness generally ranges from about at least 3 feet in the northernmost areas of the Arctic wherein the ambient summer temperatures are relatively low, and permafrost moisture content is relatively high, to 8 feet or more in the southern parts of the Arctic or sub-Arctic regions wherein higher ambient spring and summer temperatures are encountered and for longer times. Often, it is necessary to transport the gravel for such structures considerable distances when obviously little is available locally in many regions. This may be exceedingly costly and, consequently proposals have been made heretofore for providing other means for insulating and protecting the frozen Arctic and sub-Arctic substrates utilizing various methods of construction.

One of these proposals is set forth in U.S. Pat. No. 3,279,334, to Quartararo. It is proposed in this patent to place a layer of fiberglass or polyurethane plastic over the frozen ground in the winter months and along the edges of this layer, sheet piling is forced into the ground to prevent drainage and to prevent thawed soil from penetrating the frozen ground under the insulation and thus weakening the base. A layer of gravel is placed above the layer of fiberglass or polyurethane and finally a concrete road surface is applied on top of the gravel. The mean ambient temperature and duration during the summer months of the year is determined and thereafter there is selected the required thickness of the insulating plastic from known tables of insulating materials which will prevent a temperature rise in the base to a surface thawing temperature during the summer months.

The present invention not only obviates the need for great thicknesses of gravel such as that described hereinbefore and in general use in the Arctic and sub-Arctic regions, but it also obviates the disadvantages and provides advantages over other prior art structures such as that of the Quartararo patent.

In the structure of the instant invention a hydrophobic barrier or water impermeable layer of material is applied directly to the substrate whether it be the permafrost or tundra. This layer is exceedingly important since it provides a base for foaming in place the first layer of polyurethane foam. If the chemicals for forming the polyurethane rigid foam are applied directly to a cold wet surface, they do not react or foam since warm temperatures are required for the foaming which would melt the frozen substrate to produce water, and since a preferential reaction occurs between the isocyanate and the water, the polyurethane polymer does not form, i.e. the reaction is "killed". The base layer therefore permits the forming of the first polyurethane foam layer to take place without hinderance. Moreover, since it is generally the purpose to provide a road which will have a life span of a number of years, it is reasonable to assume that in a period of several years there will be at least one year in which higher than average summer temperatures will be encountered for a longer than average period of time. By the same probability, there will be at least one year in which higher than average winter temperatures will occur. Furthermore, there may be periods where "warm" summers and winters occur consecutively. The consequence of these probabilities is that excessive heat may accumulate at the insulation-permafrost interface. Thus, even though reasonable safety factors have been provided in the insulation thickness, it is quite possible that at some time during the life of the road some thawing may occur in the substrate. In the absence of a hydrophobic base coating over the substrate water will enter the polyurethane foam and thus destroy its insulation properties and cause disintegration of the road due to thawing of the substrate underneath. The effect of annual freeze-thaw on the insulation will make it progressively susceptible to water uptake. The hydrophobic base material protects the foam against this eventuality. Since the polyurethane is foamed in place to provide a rigid foam insulation which will be described further the polyurethane foam will follow and conform to surface irregularities in the tundra or permafrost. Thus, it is unnecessary to prepare the tundra or permafrost by grading or leveling, which grading would cause undesirable damage to these surfaces. By employing successive layers of foam on top of the base layer several advantages are realized. As each layer of foam is applied in place a certain degree of foaming occurs and on top of each layer there will be formed a layer of unfoamed material, generally referred to as the "skin" layer. The foam is unicellular and thus has insulating properties while the skin layer although not serving as an insulator is vapor penetration resistant thereby retarding movement of vapor into or out of the foamed layer. Moreover, this skin provides a greatly added strength both with respect to compression and flexure, much in the same manner as the well-known example of a bundle of sticks having much greater strength than a single stick of the same diameter. It is recognized that heretofore polyurethane foams have been sprayed on to surfaces for insulation purposes in layers. This, however, has been for a different reason, namely, to build up a desired thickness of foam, and in such instances it is preferred to have the foam layer as thick as possible and only if this is insufficiently thick are additional layers applied. In the instant invention the thickness of each foam layer is a critical feature of the invention and is carefully controlled to provide the desired number of layers per inch of total foam as will be described.

In the above-mentioned patented structure, piling is forced into the ground at the edges of the road to provide a moisture barrier. This is contrary to the purpose of the instant invention wherein it is desired to protect and avoid damage to the tundra surface and/or permafrost layer. Driving piles into the permafrost causes permanent and many times irreparable damage and, in addition, creates an area where subsidence and possible erodism may occur and become progressively worse each year. In the instant invention, at the edges of the roadway the layers of foam are allowed to taper down in thickness on the barrier coat to form what becomes substantially layers of skin only. As has been set forth the uppermost vapor penetration resistant layer, i.e. skin layer is coated with a hydrophobic barrier or water impermeable layer. Thus at the edges of the road even though some edge thawing occurs so that they are in contact with thawing tundra, lateral penetration of water vapor and of heat is prevented so that the interior of the structure over the frozen substrate remains as a protective structure.

In the absence of the lower and upper hydrophobic barrier the insulation, as described in the prior art, layer would behave like a wick for moisture and its insulation properties would be quickly destroyed. Thus, fiberglass, for example, is undesirable since it is not unicellular and the slightest penetration of moisture causes a wicking action to occur, thus destroying its insulating properties.

The use of polyurethane foamed in place instead of foamed in the form of rigid boards or the like provides a high structural strength since the foam follows the contour of the underlying surface and thus avoids "bridging" which in the case of rigid boards is a potential source of breakdown. Finally in providing a hydrophobic or water impermeable barrier above the uppermost skin layer on the foam, water penetration from above is avoided and thus the insulation properties and strength of the structure is maintained. None of these advantages are shown in the prior art known.

SUMMARY OF THE INVENTION

In accordance with this invention a hydrophobic or water impermeable barrier layer is applied to the substrate. This layer, for example, may constitute a bituminous material, a mixture of a bituminous material with natural or synthetic polymers, or materials such as wax resins and the like. Layers of polyurethane foam or similar synthetic polymeric foam are applied preferably by spraying on to the base layer. These are applied in a manner such that they foam in place and thus there will also be formed a vapor penetration resistant layer or "skin" on the upper surface of each foam layer. When the desired number of foam layers have been applied, in general from about three to eight layers per inch of foam depth, the uppermost layer of foam, i.e. its skin layer, is covered with a second hydrophobic or water impermeable layer which can be the same as the base layer applied to the substrate but preferably it is of a composition such that it has greater elasticity and self-sealing properties since in general it is preferred to place a layer of gravel on top of the protective structure as a means for providing protection to the structure from damage by wheeled vehicles, many of which are equipped with traction improving projections on the tires which would tend to damage or penetrate the upper hydrophobic base covering over the foam. Moreover, the gravel layer likewise distributes the load of heavy vehicles over a wide area, thus also protecting the structure. Finally, since the gravel layer contains considerable quantities of fines which form clouds of dust interfering with traffic and scattering onto the adjacent tundra damaging it, the gravel layer surface can be consolidated with a bituminous treatment. Preferably this is accomplished by applying an aqueous emulsion of a bitumen containing an elastomeric polymer in order that it will have good low temperature ductility and flexibility. This treatment should not be so heavy that the void spaces between the particles of the gravel are completely filled since this would tend to act as a heat absorbing medium and place an undue additional load on the insulation capabilities of the underlying structure.

It is an object of this invention therefore to provide a frozen substrate protective structure which has a low thermal conductivity and which protects the frozen substrate from surface disturbances due to the passage of vehicles thereover such as roadway traffic or airstrip traffic.

It is another object of this invention to provide a moisture penetration resistant frozen substrate protective structure having a low thermal conductivity suitable for the protection and prevention of thawing of the permafrost or frozen tundra in the Arctic or sub-Arctic regions.

It is another object of this invention to provide a frozen substrate protective structure having hydrophobic or water impermeable lower and upper layers with a plurality of polyurethane foam layers foamed in place between such hydrophobic layers.

It is another object of this invention to provide a frozen substrate protective structure having a hydrophobic or water impermeable base layer applied to the frozen substrate and a plurality of foamed in place polyurethane foam layers each with a vapor penetration resistant layer or skin or its upper surface applied in a manner to provide maximum compressive and flexure strength while retaining low thermal conductivity with a hydrophobic protective layer applied to the uppermost skin layer.

It is an additional object of this invention to provide a method for the production of a structure which insulates and protects the surface of the frozen substrates, such as the tundra or permafrost in the Arctic and sub-Arctic regions, and which structure serves as the base for roadways or airstrips or similar structures.

Other objects of this invention will be apparent from the following more detailed description of the invention including the preferred embodiments and from the appended claims.

DETAILED DESCRIPTION OF THE INVENTION AND THE PREFERRED EMBODIMENTS

This invention is applicable to a wide variety of frozen substrates, for example, ice, snow, frozen tundra or the permafrost itself which by definition is perpetually frozen. It is also applicable to substrates which are in a thawed condition, for example, tundra in the summer or or even permafrost which has become exposed and has thawed. In such cases, of course, application may be somewhat more difficult since the substrate may not support the vehicles employed for applying the coating without building a temporary support such as planking or the like. Likewise there may be actual "ponds" of water and in such instances these can be filled with gravel to provide a support for the base layer. If the base layer is applied to a thawed surface it is preferable to make it thick enough to prevent water from contacting the foam chemicals as will be described. This may require thicknesses of 0.1 inches or more.

When the structure of the instant invention is applied to thawed surfaces it is necessary to restrict traffic until a re-freeze of the substrate by cold weather has occurred. After the re-freeze the structure will maintain the substrate in the frozen condition and thus protect it when heavy vehicular traffic is moved over it even during the summer months.

In this aspect, the invention differs from the known prior art which required that the structure be applied to completely frozen substrates.

Whether the substrate is frozen or thawed it is a critical feature of this invention that hydrophobic or water impermeable coating be applied prior to applying the foam layers. This is required in order that no water will come into contact with the first polyurethane foam layer which is applied. If no precoat layer is employed the polyurethane which must be applied hot in order to foam in place, would melt some of the frozen substrate or otherwise come into contact with water if the substrate is in the thawed condition, and since water reacts with isocyanate preferentially as compared with the polyhydroxy alcohols or the polyol of the polyurethane formulations, the stoichiometry of the system would be disturbed with the result that poor foaming or little reaction would be obtained. Moreover, if the polyurethane foaming chemicals were applied to the cold substrate the low temperature also would prevent reaction and, thus there would be a second deleterious effect on the foam reaction so that the combined effects could substantially completely inhibit any foaming or reaction whatsoever.

It is preferred therefore to apply the hydrophobic barrier layer or "precoat" while warm and as soon thereafter as possible apply the first layer of polyurethane foam by spraying the reactants and foaming agent directly thereon. This barrier coating since it is applied warm, i.e. at a temperature above about 40° F., and preferably from 50° to 70° F., may, of course, cause a minor amount of superficial thawing of the substrate if it is in the frozen condition. However, since it is a hydrophobic material the small amount of moisture thus produced will not reach the surface sufficiently to inhibit the following polyurethane foaming reaction. It is preferred when the substrate is frozen that the hydrophobic barrier or precoat be in the range of from 5 mils to 30 mils in thickness with from about 15 to 20 mils being completely satisfactory. Under these conditions the precoat, applied warm as has been described, will allow the first polyurethane layer to foam properly and thus provide a strong coherent first foam layer. Obviously, the small amount of thawing which occurs will quickly refreeze because of the cold surface below and thus the rock-like structure of the substrate will be restored and retained during the subsequent application of the polyurethane foam layers and the final upper hydrophobic layer. If the substrate is thawed thicker precoats of the order of 0.1 inches or more, as has been described, may be required.

The hydrophobic layer which is applied as a precoat to the frozen substrate also has an additional function. As has been pointed out, over the life span of the roadway it is reasonable to assume that there will be one summer period wherein considerably higher than average temperatures will be encountered together with a longer than average period of such summer temperatures. From long term weather charts, it has been found that a long unusually warm summer can be expected once in ten years and likewise an abnormally "warm" winter can be expected once in 10 years. In such instances a small amount of thawing of the substrate may result in certain areas in spite of the safety factors which have been built into the roadway. In these instances the lower hydrophobic layer prevents penetration of moisture into the foam layers which when refreezing occurs would cause them to degrade and lower their insulation characteristics, and thus eventually cause complete failure of the road and degradation. In other words, the lower hydrophobic layer also provides an additional safety factor for unusual weather conditions.

The composition of the hydrophobic or water impermeable precoat layer is preferably bituminous. Although asphalts, pitches or various synthetic polymer resins and the like could be used because of their water impermeability characteristics, they have certain disadvantages. Hot asphalts if applied to thawed surfaces could actually form steam which would rupture the asphalt coating. If applied as "cut-backs", i.e. naphtha or solvent solutions there would be a fire hazard when the hot polyurethane reactants were applied. Aqueous emulsions are not desirable since, as has been pointed out, water is very deleterious to the polyurethane reaction. Moreover, the precoat should be sufficiently warm so that the polyurethane will foam properly.

Synthetic polymeric sheeting such as polyethylene sheeting and the like have been considered, but in addition to their cost, they would have to be heated before the foam was applied and in addition such sheets would not follow the irregular contour of the surface so that bridging would occur with inherent weakness to th structure. Moreover, any sharp rocks, pieces of ice or other projections on the surface would tend to pierce the sheet and thus cause a break in the hydrophobic barrier.

It has been found that a "long" crude oil residuum can be used as the bituminous barrier material. Thus, for example, the crude oil from the North Slope of Alaska is topped to remove the most volatile part of the crude amounting to about 10 volume per cent. This can be utilized as fuel or can be added to other crude for shipment or transport. The next 20 volume per cent of the crude is removed for use as diesel fuel. This is required for use in trucks, machinery, power generation and the like. The 70 volume per cent residual fraction boiling above the boiling range of the diesel fuel fraction has been found to be particularly suitable as a hydrophobic or water impermeable base material for the precoat. This can be used without further treatment or it can be air blown to increase its viscosity and the oxidized material employed.

It is preferred, however, to employ a small amount of polymeric material in the residual fraction in order to provide the residuum with increased viscosity and better ductility and flexibility at low temperatures. A completely satisfactory lower hydrophobic or water impermeable layer or precoat material consists of 85 weight per cent of the 70 volume per cent Alaskan crude residuum, 10 weight per cent of commercial low molecular weight polyethylene (19,000 number average molecular weight) and 5 weight per cent of a commercial sytrene-butadiene rubber having a Mooney viscosity, ML4′ at 212° F. of 105 – 110. In general, the polyethylene can have a number average molecular weight in a range of 18,000 to 30,000 and the styrene-butadiene rubber can have Mooney viscosities, ML4′ at 212° F. of 45 – 110.

The polymeric material is incorporated into the residuum at a temperature sufficiently high, for example 140° F. or higher such that the residuum is highly fluid and thereafter the warm 50° F. to 70° F. mixture is applied to the substrate. The polymer content of the residuum-polymer mixture can range conveniently from 5 to 25 weight per cent of the mixture with the amount of polyethylene to styrene-butadiene rubber ranging in weight ratio from 1:1 to 3:1. Although none of these proportions are extremely critical, large deviations from them give less desirable materials both from the standpoint of cost and also performance.

The precoat material is preferably applied by spraying and consequently since a relatively thin coating, i.e. from 5 to 30 mils, preferably 15 to 20 mils, is desired on frozen substrates the viscosity of such material should not be so high that a uniform coating cannot be attained. When the precoat is applied to thawed substrates it can be somewhat more viscous since thicker coatings are desired, but uniformity is also a desirable object in these applications. If desired the residual component may be air blown to increase its viscosity somewhat and thus less polymer need be added to give the proper viscosity, however, as stated, some elastomeric polymer is desirable in order that the precoat will have good low temperature ductility and flexibility. This is also desirable in the precoat for thawed surfaces since when refreezing occurs the coating should have good low temperature flexibility to compensate for any "heaving" due to freezing.

The polyurethane foam is produced in accordance with well-known principles of formulating such foams as will be shown in the Examples hereinafter. These foams which are produced by reaction between a polyol, i.e. a polyhydroxyl compound and a diisocyanate generally in the presence of a catalyst and blowing agents are preferably produced as has been described by spraying techniques in order that foaming will occur in place and follow the uneven contours of the substrate which has been covered with a relatively thin layer of the precoat material. In general, the stoichiometric relationship is that one hydroxyl group of the polyol reacts with one isocyanate group of the diisocyanate or polyisocyanate and it is preferred that this 1:1 relationship be maintained as closely as possible for the best quality foam. Frequently, however, there may be present small quantities of impurities such moisture or the like which may require that a small excess of isocyanate groups be present in order to obtain the desired 1:1 relationship.

The art relating to polyurethane foams is well developed and a very wide variety of formulations are available commercially which are suited to the mode of application, the conditions of application, physical properties of the foam which are desired and the like. These formulations are not a specific part of the instant invention since in many instances they are proprietary products designed for specific methods of application and to give foams of specified properties. The manufacturers of the components can formulate from their knowledge of their specific components, a formulation which will meet the requirements of any particular application.

In general, the urethane foams of this invention have a compressive strength in excess of 30 psi at yield, a "K" factor (insulation value) of less than about 0.13 BTU/hr./sq. ft./° F./inch initially as formed, 90 to 95 per cent closed cell, 3 to 5 per cent deflection at yield and densities of 2.5 to 5.0 lbs./cu. ft. preferably for economic reasons 2.5 to 3.5 lbs./cu. ft.

It has been found that in accordance with this invention that it is necessary to control the thickness of the foam layers to from ⅛ to ⅓ inches in thickness, i.e. so that there are from 8 to 3 foam layers per inch, with 4 to 5 layers per inch being preferred.

The foam layers should be applied in a manner to give the desired thickness for each layer as uniformly as possible. Hand spraying by a skilled operator can be used although completely automated machine spraying is preferable. When the layers are applied under extremely adverse weather conditions it may be necessary to provide wind screens, tents or similar protective devices in order to insure proper application of the foam layers.

An important variable which must be taken into account in applying successive layers of foam is that in order to obtain proper cohesion between the layers while still allowing the formation of the "skin" layers is that the time should be allowed for the formation of the skin so that it is uniform and free from discontinuities before the next layer is applied. In order to get chemical bonding and consequently greater cohesion and strength, it is preferred to apply the next layer of foam before the skin layer on the layer of foam below has completely cured. If the environmental temperature remains constant or increases, a longer time can be allowed before the next layer of foam is applied since even if curing has occurred almost completely the next layer of foam will still cohere relatively well. If, however, the temperature decreases both with respect to the lower foam layer and environmental temperature then it is preferable to apply the next layer of foam as soon as possible in order to obtain good cohesion. In general, the next layer of foam should be applied within ½ to 30 minutes after the layer below it has completed foaming. This permits the lower skin layer to be completely formed without being completely cured and at the same time allows for variations in temperature.

It should be understood that these times are provided for a general guide, but it will also be understood that because of the variables involved, such as ambient weather conditions, foam compositions, application methods and the like it is not possible to give absolute times which must be used in every application. The critera are that the first layer be allowed to foam and form a skin but before such skin has become permanently cured or the ambient temperature conditions have dropped markedly along with the temperature of the lower foam layer the next layer of foam should be applied in order to obtain the desired cohesion.

The total thickness of foam necessary to protect any given substrate is a function of a larger number of variables. As a general rule, when employing a foam having the physical characteristics above-enumerated, thickness ranging from about 1 inch to 2 feet will encompass nearly all situations. The variables involved are climatic conditions, for example, the air freezing index which is measured in degree days, calculated by multiplying days by degrees F. below 32° F.; the air thawing index in degree days calculated by multiplying days by degrees F. above 32° F.; the mean annual air temperature; the mean annual soil surface temperature; the air temperature amplitude, i.e. variation; the soil surface temperature amplitude and the type of soil or substrate composition for the given locality together with the type of protection desired, i.e. whether for a "5 year road", a "10 year road" or a "20 year road" and whether such protection is for heavy vehicle primary road traffic, lighter vehicle traffic or simply a pad to protect the substrate under camps, buildings, storage areas and the like.

Various equations have been developed taking into account these variables together with the insulation values of the foam insulation material. These calculations which do not form a part of the instant invention can be used however for calculating the total thickness of foam required for any particular insulation utilizing the structure of this invention. These foam thicknesses and the related calculations are set forth in detail in two publications, "Design and Evaluation of Insulated and Uninsulated Roadway Embankments for the Arctic", by George R. Knight and Albert C. Condo, set forth in Publication of Proceedings Cold Regions Engineering Symposium, Alaska Section, American Society of Civil Engineers and 21st Annual Science Conference, University of Alaska, August 17 – 19, 1970, and "Insulated Gravel Embankments for Arctic Road Construction", Paper No. SPE3378, by A. C. Condo, J. F. McGrogan and Glenn R. Burt, published by the Society of Petroleum Engineers of AIME, 6200 North Central Expressway, Dallas, Tex. 75206, (1971).

As has been stated, it is preferable to use a polyurethane foam designed for low temperature application since polyurethane foams are readily adaptable to usage in spray application apparatus.

In addition to the polyol and polyisocyanate components of the urethane foam the foam formulation generally includes a blowing agent for low temperature application, such as a fluorinated hydrocarbon. Preferred fluorinated hydrocarbons include the fluorinated methanes, such as trichloromonofluoromethane, dichlorodifluoromethane, monochlorotrifluoromethane, monobromotrifluoromethane, tetrafluoromethane and the like. The volume per cent and type of fluorinated hydrocarbon employed is dependent upon environmental conditions such as temperature at the time the polyurethane is applied. A low boiling agent is employed if the temperature is below about 60° F. and amounts ranging up to 5 volume per cent of blowing agent may be used although generally the amount required is somewhat less than this. For example, at a temperature of about 50° F. from 1 to 2 per cent by volume of fluorinated hydrocarbon will usually be sufficient while at temperatures of about 70° F., 0.5 per cent by volume of fluorinated hydrocarbon is sufficient.

Although it is preferred to incorporate the blowing agent in the foam formulation if environmental conditions permit, i.e. temperature, low wind velocity and the like, gaseous blowing agents may be used in the spraying technique. Generally, however, in the areas where the instant structure has its greatest utility such techniques are not suitable.

The urethane foam is obtained by blending together the polyol and isocyanate components. These components are, as has been stated, well-known in the art. It is generally desirable to include not only the blowing agent as has been described, but also any of the well-known catalyst compositions together with other components such as surfactants and the like, all of which are a part of the known conventional polyurethane art. In general, in the instant invention since it is desired to maintain a stoichiometric ratio of about one hydroxyl group to one isocyanate it is preferred to employ polyol and polyisocyanate components having molecular weights such that equal parts by weight or volume can be blended to give the urethane foam. It is also desirable that the viscosity of the two components be generally similar such that normal fluctuations in the ambient temperature has only a minimal effect on the metered ratio. The following Example is provided to illustrate the invention in greater detail.

EXAMPLE

A substrate protective structure for a roadway having a useful life of 20 years in the Prudehoe Bay area of Alaska is prepared as follows:

To a permafrost substrate a lower hydrophobic or water impermeable base layer is applied with conventional, manual, hot-spray equipment, heated so that after application the base layer will be at about 75° F. This layer is a liquid bituminous mixture of Prudhoe Bay 70 volume per cent crude residuum, as described hereinbefore, extended with about 10 weight per cent of commercial low molecular weight polyethylene having a number average molecular weight of about 19,000 and 5 weight per cent of a commercial styrene-butadiene rubber having a Mooney viscosity of ML4′ of 212° F. at 105 – 110. Depending upon the condition of the substrate the thickness of this base layer ranges from 15 mils in thickness on frozen substrate to 0.1 inches or more on thawed substrates. After the bituminous layer has been applied and while still warm, polyurethane foam insulation is applied with conventional foam spray equipment such as a Gusmer pneumatic-mix spray apparatus having a base heater providing a 140° F. block temperature and a 115° – 120° F. hose temperature. The polyurethane is obtained from equal parts of a polyether-polyol and a polyisocyanate wherein the polyol has a Brookfield viscosity of 200 cps at 77° F. and a density of 10.3 pounds per gallon and the polyol additionally contains 2 per cent by volume of trichlorofluoromethane blowing agent as well as the catalyst. The polyisocyanate is a black liquid having a Brookfield viscosity of about 250 cps of 70° F. and a density of about 9.8 pounds per gallon.

The foam components are spray-applied in superimposed layers wherein each layer is allowed to set but not to become completely cured to provide a multilaminate structure. A foam of 1½ inches in total thickness is applied in successive layers of 4 to 5 per inch so that each layer is separated by a high density laminar skin several mils in thickness wherein the skin is formed by exposure of the upper surface of each layer to air, the time being a function of the ambient temperature as has been described. At an environmental temperature of about 70° F. the foam would rise in about 6 seconds and set in about 12 seconds, but the total time for complete cure would range up to 30 minutes or more.

Properties of the spray-applied polyurethane foam are shown below.

| Property | Units | Rating | Test Method |
|---|---|---|---|
| Core Density | lbs/ft³ | 2.1–2.4 | ASTM-D-1622-63 |
| Overall Density | lbs/ft³ | 2.7–2.8 | ASTM-D-1622-63 |
| Closed Cell Content | % | 90 | Pycnometer |
| Open Cell Content | % | 6.8 | |
| Compressive Strength 5% Deflection | PSI | 50 | ASTM-D-1621-64 |
| K Factor at 70° F. | BTU/hr/ft² ° F/in | 0.11 | ASTM-D-2326-64T |

After the uppermost layer of polyurethane foam skin has cured substantially completely, this skin layer is coated with a second hydrophobic or water impermeable layer which can be of the same composition as the base layer but preferably contains a greater quantity of extender, i.e. of the order of up to 25 per cent or more as has been described, and preferable of a thickness of 0.1 inches or more in order to provide protection to the uppermost layer not only from moisture penetration but also from rupture. Although this structure is suitable alone as a protective structure when relatively moderately severe uses are contemplated, it is necessary in the case when it is to be used for building roadways subjected to vehicular traffic, particularly heavy vehicular traffic, that the structure be covered with gravel preferably from about 18 inches to 24 inches in thickness in order to prevent wheeled vehicles from damaging the structure and to provide a means for distributing heavy loads over a wider area of the structure than the contact area between the wheel and the gravel surface.

As has been pointed out, if the gravel overburden contains considerable quantities of fines a coating of bituminous material may be spread over the surface to consolidate and prevent the fines from dusting, but this consolidation should be so light that the void spaces between the particles are not completely filled. If the void spaces are filled and the roadway compacted to form an asphalt-like surface this will act as a heat sink and absorb radiant heat from the sun as well as from the atmosphere which in turn will place an undue burden on the insulating structure below.

Although about 1½ inches of foam with 18 – 22 inches of gravel are adequate in the Prudhoe Bay area for a 20 year life road subjected to heavy vehicular traffic a slightly thinner total layer of foam can be employed at Point Barrow, Alaska, because of the more severe climatic conditions there, whereas at Umiat a thickness of 2.1 inches may be required because of the somewhat milder climatic conditions. In all instances, however, the structure is that which has been described, i.e. a hydrophobic or water impermeable base layer, successive layers of polyurethane foam each having an upper skin surface and finally an upper hydrophobic or water impermeable layer to protect the foam from a gravel or similar overburden.

We claim:

1. An insulating and protective structure for frozen substrates comprising a base layer of long crude oil composition containing synthetic polymer on said substrate, a plurality of successive superimposed layers of polyurethane foam, foamed in place, on said base layer at a thickness sufficient to provide about three to eight layers per inch wherein each of said foam layers has an unfoamed skin layer on its upper surface and each layer is bonded to the skin of the polyurethane layer beneath it, and an upper layer of long crude oil composition containing synthetic polymer on the uppermost foam layer.

2. A structure according to claim 1 wherein said polyurethane foam has a compressive strength in excess of 30 psi at yield and a "K" factor less than about 0.13 determined initially as foamed.

3. A structure according to claim 1 wherein said synthetic polymer is selected from the group consisting of low molecular weight polyethylene and styrene-butadiene rubber.

4. A structure according to claim 1 wherein said foam is applied at a thickness sufficient to provide about four to five superimposed layers per inch.

5. A structure according to claim 1 wherein said frozen substrate is permafrost.

6. A method of insulating and protecting frozen substrates which comprises applying to the surface of said substrate a base layer 15 mils to 0.1 inch thick of long crude oil composition containing synthetic polymer, foaming in place on said base layer successive superimposed layers of polyurethane foam at a thickness sufficient to provide three to eight layers per inch in a manner to provide each layer with a non-foamed skin on its upper surface with the next succeeding foam layer being applied before the skin of the preceding layer has completely cured with the result that the succeeding layer coheres to said preceding foam skin surface and applying to the skin layer on the uppermost foam layer a protective layer of long crude oil composition containing synthetic polymer.

7. A method according to claim 6 wherein the number of successive superimposed layers is from about four to five per inch.

8. A road construction comprising an insulating and protective structure for frozen substrates, a gravel layer on the protective structure and a wearing surface on said gravel layer, said structure being a base layer about 5 to 30 mils thick of long crude oil composition containing about 5 to 25% by weight synthetic polymer on said substrate, a plurality of successive superimposed layers of polyurethane foam, foamed in place at a thickness sufficient to provide three to eight layers per inch on said base layer wherein each of said foam layers has an unfoamed skin layer on its upper surface, and each layer is bonded to the skin of the polyurethane layer beneath it and an upper layer at least 0.1 inch thick of long crude oil composition containing about 5 to 25% by weight synthetic polymer on the uppermost foam layer.

* * * * *